US011791523B2

(12) United States Patent
Hasegawa

(10) Patent No.: US 11,791,523 B2
(45) Date of Patent: Oct. 17, 2023

(54) BANDPASS FILTER

(71) Applicant: FUJIKURA LTD., Tokyo (JP)

(72) Inventor: Yuta Hasegawa, Sakura (JP)

(73) Assignee: FUJIKURA LTD., Tokyo (JP)

( * ) Notice: Subject to any disclaimer, the term of this patent is extended or adjusted under 35 U.S.C. 154(b) by 62 days.

(21) Appl. No.: 17/633,027

(22) PCT Filed: Feb. 19, 2021

(86) PCT No.: PCT/JP2021/006399
§ 371 (c)(1),
(2) Date: Feb. 4, 2022

(87) PCT Pub. No.: WO2021/240919
PCT Pub. Date: Dec. 2, 2021

(65) Prior Publication Data

US 2022/0285812 A1 Sep. 8, 2022

(30) Foreign Application Priority Data

May 29, 2020 (JP) ..... 2020-094701

(51) Int. Cl.
*H01P 1/203* (2006.01)
*H01P 7/08* (2006.01)

(52) U.S. Cl.
CPC ..... *H01P 1/20363* (2013.01); *H01P 1/20381* (2013.01); *H01P 7/082* (2013.01)

(58) Field of Classification Search
CPC .. H01P 1/20363; H01P 1/20354; H01P 1/203; H01P 1/20327; H01P 1/20381; H01P 7/082; H01P 7/084; H01P 7/08; H01P 7/088
See application file for complete search history.

(56) References Cited

FOREIGN PATENT DOCUMENTS

| | | | |
|---|---|---|---|
| CN | 1224253 | A | 7/1999 |
| CN | 101447595 | A | 6/2009 |
| CN | 106450601 | A | 2/2017 |
| CN | 107293831 | A | 10/2017 |
| EP | 3 996 199 | A1 | 5/2022 |
| JP | 63-267001 | A | 11/1988 |

(Continued)

OTHER PUBLICATIONS

International Search Report dated Apr. 20, 2021, issued in counterpart International Application No. PCT/JP2021/006399, with English Translation. (5 pages).

(Continued)

*Primary Examiner* — Stephen E. Jones
(74) *Attorney, Agent, or Firm* — WHDA, LLP

(57) ABSTRACT

This invention reduces, in a type of bandpass filter that is called a strip-line filter or a microstrip filter, a variation in filter characteristics that can occur in a case where the design of the first line and the second line is changed. The bandpass filter (filter 10) includes a ground conductor layer, n resonators (141 to 146), and first and second lines (lines 151, 152), wherein the first and second lines (lines 151, 152) are respectively connected to a third side (side R13) of a first resonator (resonator 141) and a seventh side (side R63) of an n-th resonator, a gap (G1) is provided in an area of a fourth side (side R14) which area is close to a second resonator (resonator 142), and a gap (G6) is provided in an area of an eighth side (side R64) which area is close to an n−1-th resonator (resonator 145).

9 Claims, 5 Drawing Sheets

(56) References Cited

FOREIGN PATENT DOCUMENTS

| | | | |
|---|---|---|---|
| JP | 2000-357903 | A | 12/2000 |
| JP | 2001-68902 | A | 3/2001 |
| JP | 2004-260510 | A | 9/2004 |
| JP | 2005-117433 | A | 4/2005 |
| JP | 2007-208688 | A | 8/2007 |
| JP | 2007-318271 | A | 12/2007 |
| JP | 2009-246810 | A | 10/2009 |
| JP | 2012-23427 | A | 2/2012 |
| JP | 2016-58822 | A | 4/2016 |

OTHER PUBLICATIONS

Written Opinion of the International Searching Authority (Form PCT/ISA/237) dated Apr. 20, 2021, issued in counterpart International Application No. PCT/JP2021/006399. (3 pages).

Hong et al., "Electronics Letters", Nov. 9, 1995, vol. 31, No. 23, pp. 2020. Cited in Specification. (3 pages).

Jia-Sheng Hong et al: "Theory and Experiment of Novel Microstrip Slow-Wave Open-Loop Resonator Filters ", IEEE Transactions on Microwave Theory and Techniques, IEEE, USA, vol. 45 , No. 12, Dec. 1, 1997 (Dec. 1, 1997), XP011037032, ISSN: 0018-9480 * sections 1, II and 111.; p. 2358-p. 2360; figures 1a, 1b,5d *; Cited in Extended European Search Report dated Sep. 28, 2022.(8 pages).

International Preliminary Report on Patentability (Form PCT/IB/373) issued in counterpart International Application No. PCT/JP2021/006399 dated Nov. 17, 2022, with Form PCT/ISA/237. (4 pages).

J.S. Hong, et al. "Microstrip Slow-Wave Open-Loop Resonator Filters", 1997 IEEE MTT-S International Microwave Symposium Digest, pp. 713-716; Cited in JP Office Action dated Aug. 30, 2022. (5 pages).

BANDPASS FILTER

TECHNICAL FIELD

The present invention relates to a bandpass filter.

BACKGROUND ART

FIG. 1 of Non-Patent Literature 1 illustrates a bandpass filter including: a substrate made of a dielectric; a ground conductor layer provided on a main surface on a lower side of the substrate; and n resonators, a first line, and a second line provided on a main surface on an upper side of the substrate.

The n resonators are each made of a long narrow conductor bent into a rectangular shape so that the ends of the long narrow conductor have a gap therebetween. The n resonators are arranged in two rows and n/2 columns. Here, assume that a resonator disposed on a first row and a first column is a first resonator, a resonator disposed on the first row and a second column is a second resonator, a resonator disposed on a second row and the first column is an n-th resonator, and a resonator disposed on the second row and the second column is an n−1-th resonator. Assume also that, out of the four sides of the first resonator, a side close to the second resonator is a first side, a side close to the n-th resonator is a second side, a side opposite to the first side is a third side, and a side opposite to the second side is a fourth side. Assume also that, out of the four sides of the n-th resonator, a side close to the n−1-th side is a fifth side, a side close to the first resonator is a sixth side, a side opposite to the fifth side is a seventh side, and a side opposite to the sixth side is an eighth side.

The first line is connected to a part of a long narrow conductor constituting the first resonator which part is near a midpoint of the long narrow conductor, and the second line is connected to a part of a long narrow conductor constituting the n-th resonator which part is near a midpoint of the long narrow conductor. The first line and the second line function as lines that allow input/output of a high frequency signal to/from the bandpass filter.

The bandpass filter configured as above is one example of a microstrip filter. On the n resonators, the first line, and the second line of this microstrip filter, another substrate made of a dielectric and another ground conductor layer can be stacked. Consequently, the bandpass filter shown in FIG. 1 is transformed into a strip-line filter including a strip line.

CITATION LIST

Non-Patent Literatures

Non-Patent Literature 1

J. S. Hong and M. J. Lancaster, Electronics LETTERS, 9 Nov. 1995, Vol. 31, No. 23, p. 2020.

SUMMARY OF INVENTION

Technical Problem

The bandpass filter shown in FIG. 1 employs a configuration in which an i-th resonator, which is a resonator at an i-th place (i is an integer of not less than 1 and not more than n−1), and an i+1-th resonator, which is a resonator at an i+1-th place, are magnetically coupled to each other and the first resonator and the n-th resonator are electrostatically coupled to each other. In this case, the first resonator has a gap provided in the second side, and the n-th resonator has a gap provided in the sixth side. As described above, the first and second lines are respectively connected to the parts of the long narrow conductors constituting the resonators which parts are near the midpoints of the long narrow conductors. Specifically, the first line is connected to a part of the third side which part is near an end of the third side farther from the n-th resonator, and the second line is connected to a part of the seventh side which part is near an end of the seventh side farther from the first resonator. Thus, in the bandpass filter shown in FIG. 1, a distance between the first line and the second line can be easily increased.

Meanwhile, depending on the design policy of the bandpass filter, another configuration may be employed in which a first resonator and an n-th resonator are magnetically coupled to each other and a second resonator and an n−1-th resonator are electrostatically coupled to each other. Also in this case, the first resonator and the second resonator are required to be magnetically coupled to each other. Specifically, the first resonator is required to be magnetically coupled to the second resonator and to the n-th resonator and the n-th resonator is required to be magnetically coupled to the first resonator and to the n−1-th resonator. A filter 2010, which is a bandpass filter configured as such, is shown in FIG. 5. FIG. 5 is a perspective view of the filter 2010.

As shown in FIG. 5, the filter 2010 is a strip-line filter including a multilayer substrate 2011, ground conductor layers 2012 and 2013, six resonators 2141 to 2146, and lines 2151 and 2152. The multilayer substrate 2011 is constituted by a substrate 2111 and a substrate 2112, which are two plate-like substrates each made of a dielectric. The ground conductor layers 2012 and 2013 are respectively provided to paired outer layers of the multilayer substrate 2011. The resonators 2141 to 2146 and the lines 2151 and 2152 are provided in an inner layer of the multilayer substrate 2011. The resonator 2141 is a first-pole resonator, and the resonator 2146 is a last-pole resonator. The line 2151 is the first line, and the line 2152 is the second line. The line 2151 is connected to the resonator 2141, and the line 2152 is connected to the resonator 2146.

Also in the filter 2010 configured as above, the resonators 2141 and 2142 are required to be magnetically coupled to each other. That is, it is required that the resonator 2141 be magnetically coupled to the resonator 2142 and to the resonator 2146 and the resonator 2146 be magnetically coupled to the resonator 2141 and to the resonator 2145.

In order to satisfy this condition, the resonators 2141 and 2146 are preferably arranged such that one of the four sides of the resonator 2141 which one includes a gap G1 and one of the four sides of the resonator 2146 which one includes a gap G6 are most distant from each other. This inevitably shortens a distance between the lines 2151 and 2152.

As described above, in this bandpass filter, the distance between the first and second lines is short. Thus, the first line and the second line are easily coupled to each other. As a result, in a case where the design of the first line and the second line is changed in this bandpass filter, the filter characteristics are likely to vary.

The present invention was made in view of the above-described problem, and has an object to reduce, in a type of bandpass filter that is called a strip-line filter or a microstrip filter, a variation in filter characteristics that can occur in a case where the design of the first line and the second line is changed.

Solution to Problem

In order to attain the above object, a bandpass filter in accordance with an aspect of the present invention includes:

at least one ground conductor layer; n resonators arranged in two rows and n/2 columns in a layer spaced from the at least one ground conductor layer, n being an even number of not less than 4, each of the n resonators being made of a long narrow conductor bent into a shape having at least four sides and having a gap; and a first line and a second line each made of a long narrow conductor, wherein among the n resonators, a resonator disposed on a first row and a first column is a first resonator, a resonator disposed on the first row and a second column is a second resonator, a resonator disposed on a second row and the first column is an n-th resonator, and a resonator disposed on the second row and the second column is an n−1-th resonator, in the first resonator, a side close to the second resonator is a first side, a side close to the n-th resonator is a second side, a side opposite to the first side is a third side, and a side opposite to the second side is a fourth side, in the n-th resonator, a side close to the n−1-th resonator is a fifth side, a side close to the first resonator is a sixth side, a side opposite to the fifth side is a seventh side, and a side opposite to the sixth side is an eighth side, the first line is connected to the third side and the second line is connected to the seventh side, and the first resonator has a gap in an area of the fourth side which area is close to the second resonator, and the n-th resonator has a gap in an area of the eighth side which area is close to the n−1-th resonator.

A bandpass filter configured as above is a type of bandpass filter that is called a strip-line filter or a microstrip filter.

Advantageous Effects of Invention

In accordance with an aspect of the present invention, it is possible to reduce, in a type of bandpass filter that is called a strip-line filter or a microstrip filter, a variation in filter characteristics that can occur in a case where the design of the first line and the second line is changed.

Figure 4:
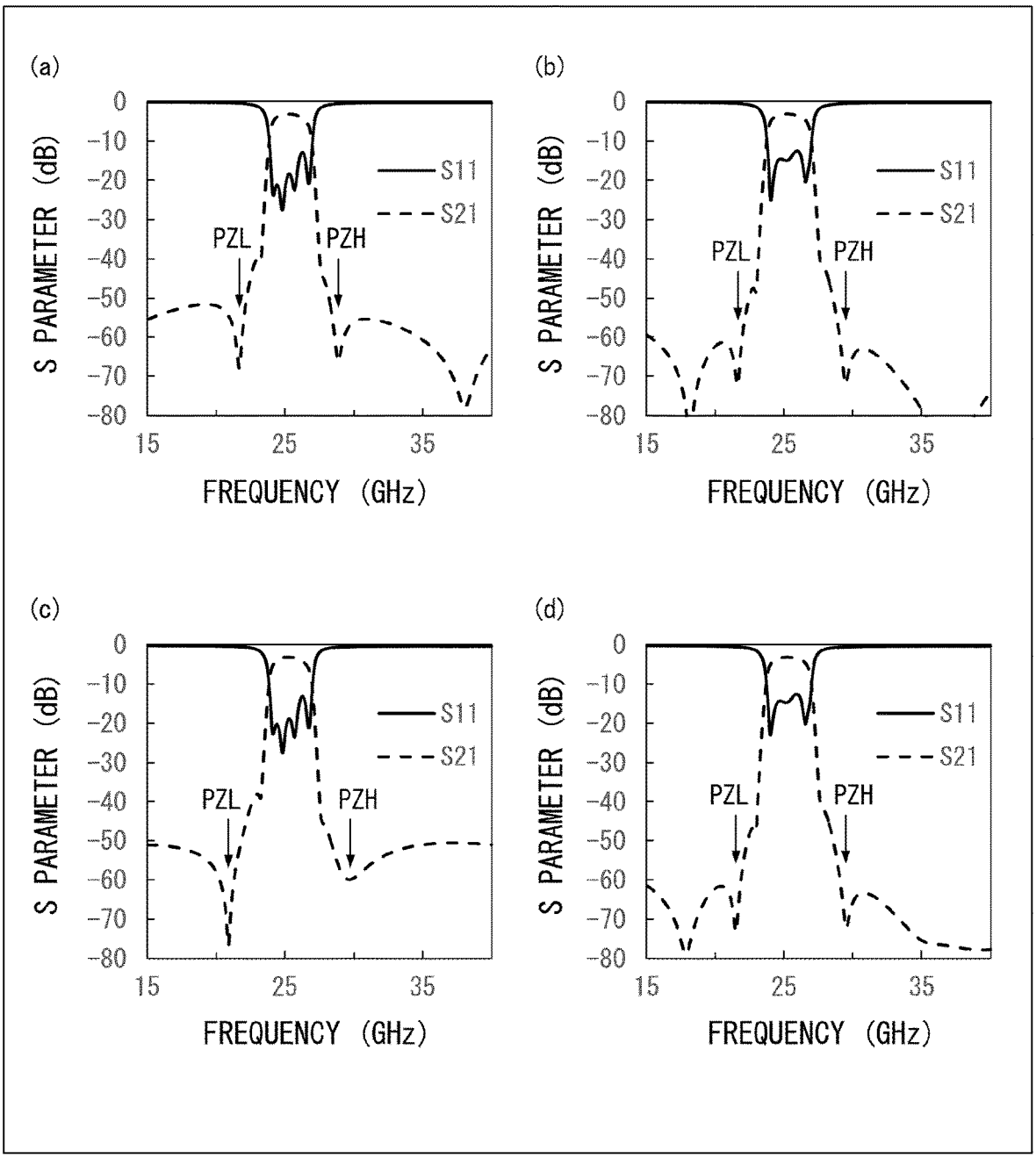

(a) to (d) of FIG. 4 respectively show graphs indicating S parameters of Comparative Example 1 of the present invention, Example 1 of the present invention, Comparative Example 2 of the present invention, and Example 2 of the present invention.

Figure 5:
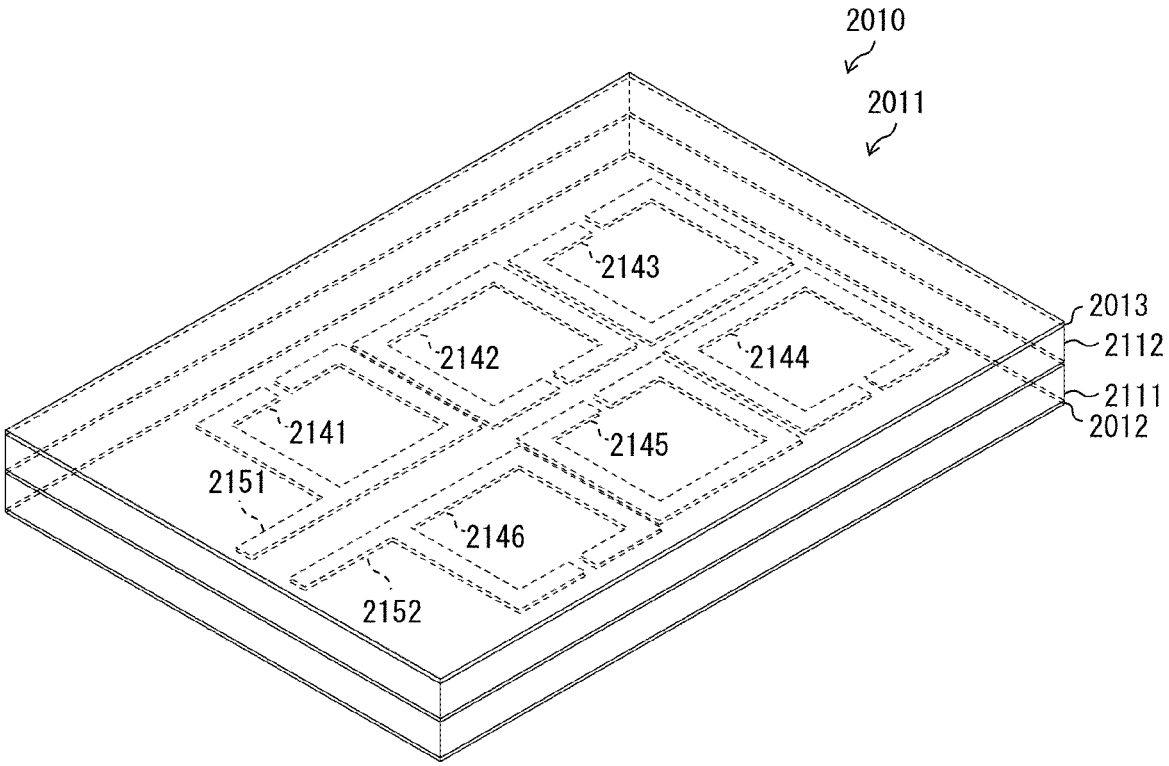

FIG. 5 is a perspective view of a conventional bandpass filter.

DESCRIPTION OF EMBODIMENTS (Configuration of Filter)

Figure 1:
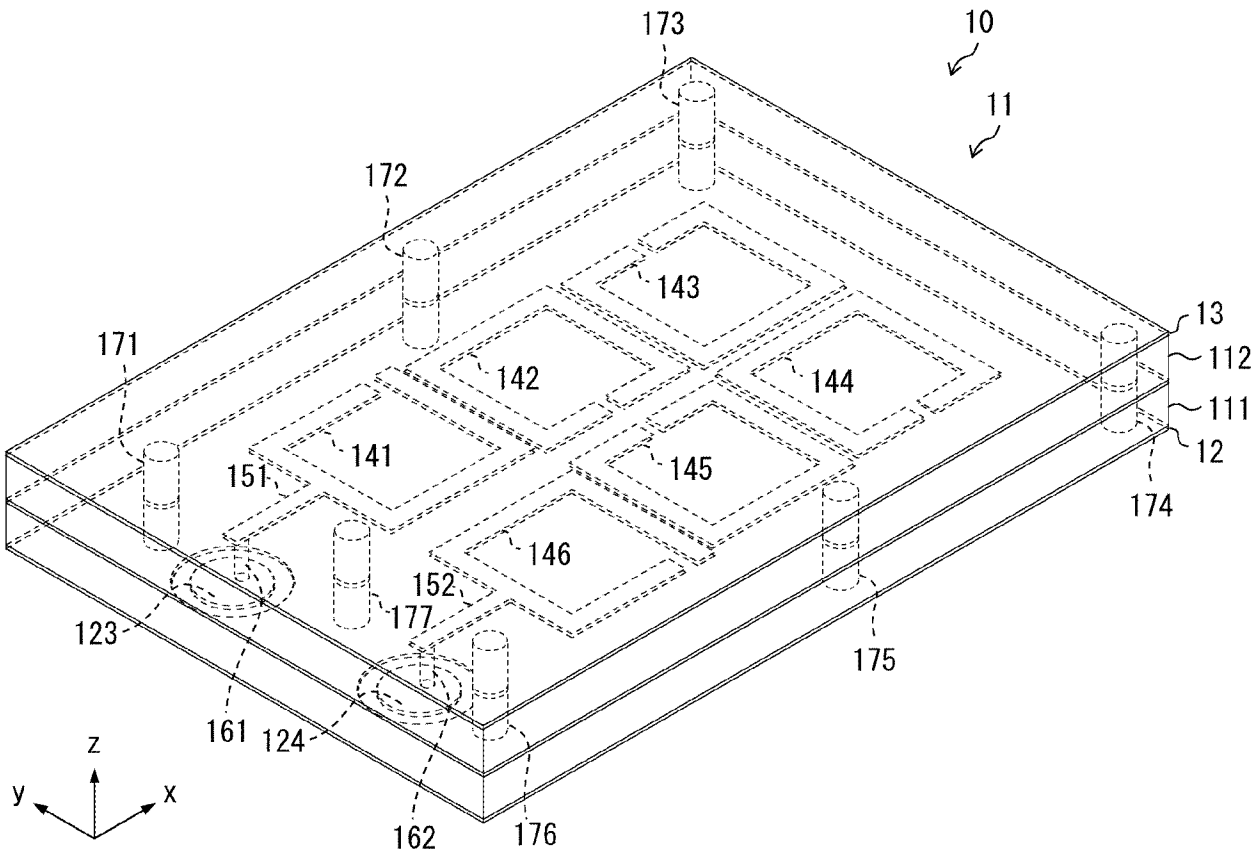
FIG. 1 is a perspective view of a filter in accordance with an embodiment of the present invention.
Figure 2:
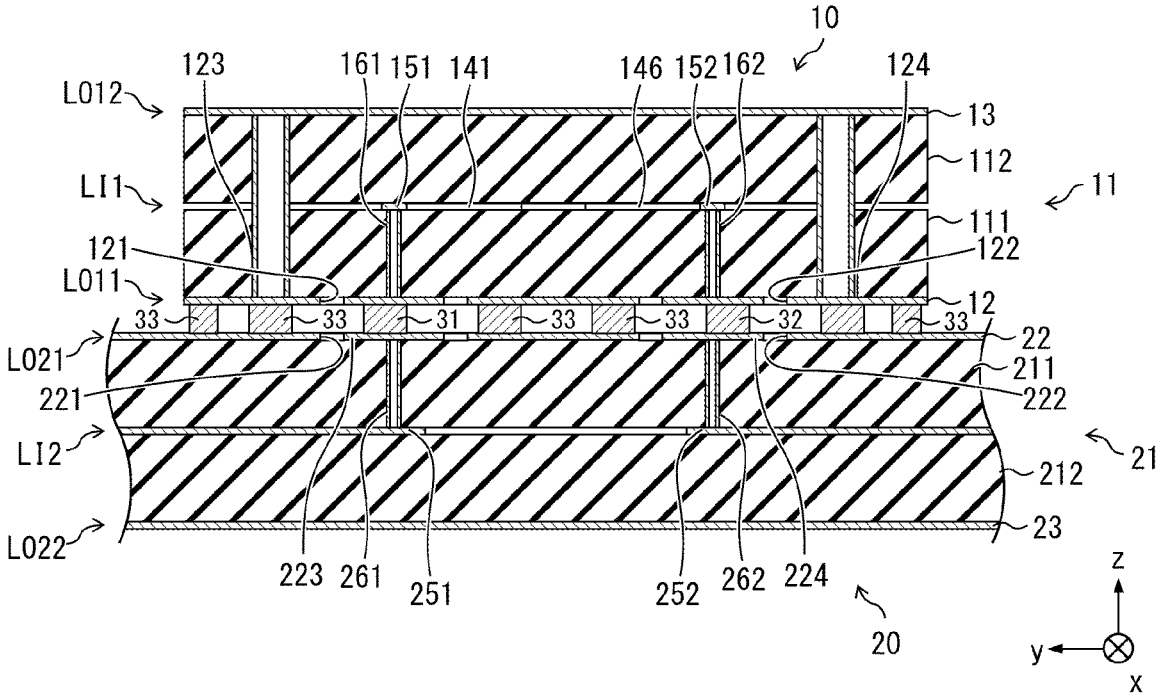
FIG. 2 is a cross-sectional view of the filter shown in FIG. 1.
Figure 3:
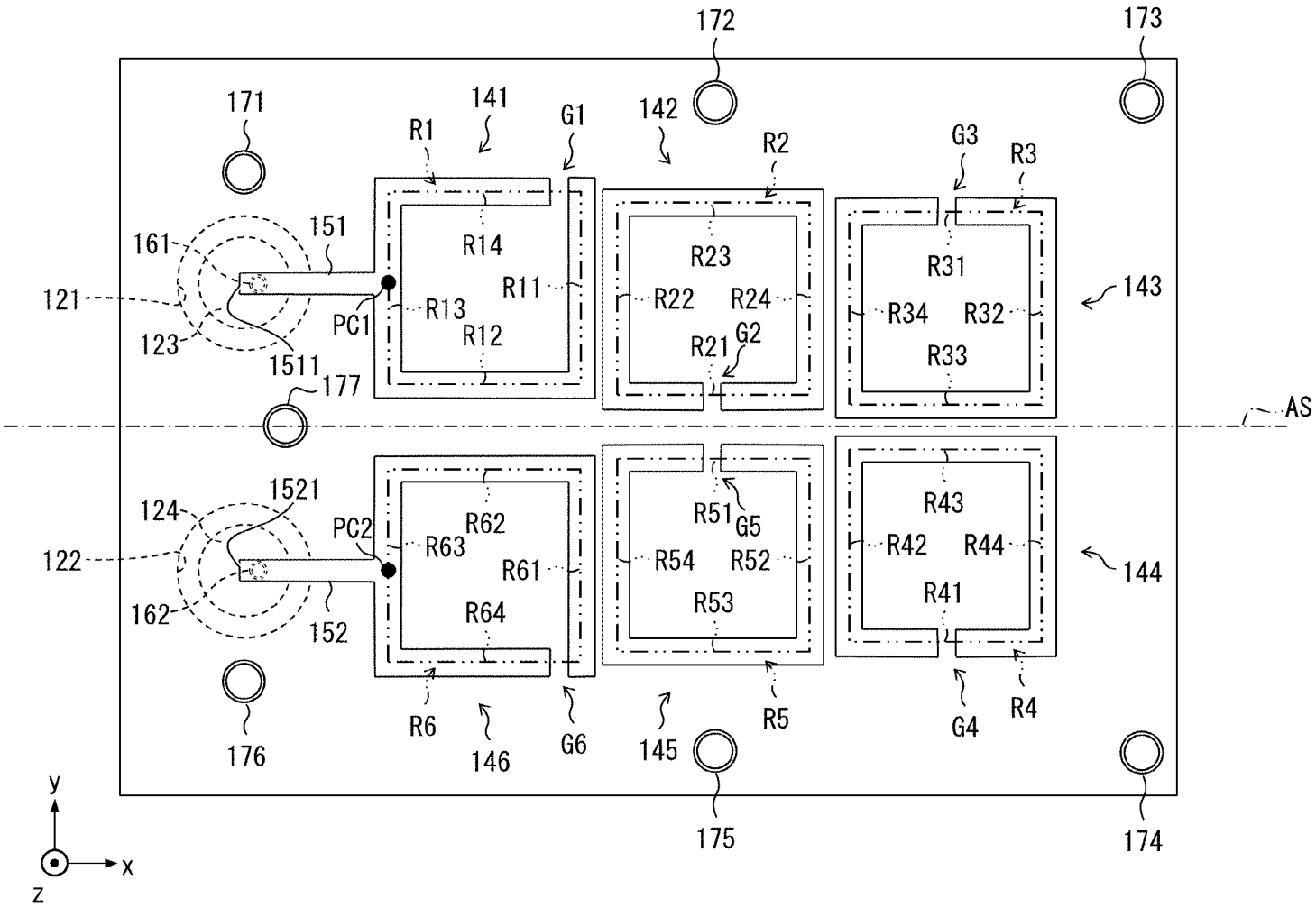
FIG. 3 is a plan view of n resonators included in the filter shown in FIG. 1.

With reference to FIGS. 1 to 3, the following description will discuss a filter 10, which is a bandpass filter in accordance with an embodiment of the present invention. The following description will also discuss a mounting substrate 20, on which the filter 10 is to be mounted, with reference to FIG. 2. FIG. 1 is a perspective view of the filter 10. FIG. 2 is a cross-sectional view of the filter 10. Note that FIG. 2 illustrates a cross section of the filter 10 taken along a plane including central axes of vias 161 and 162 included in the filter 10. The filter 10 shown in FIG. 2 is in a state where the filter 10 is mounted on the mounting substrate 20. FIG. 3 is a plan view of resonators 141 to 146 and lines 151 and 152 included in the filter 10. Note that, in FIG. 3, a substrate 112 and a ground conductor layer 13, each of which is included in the filter 10, are not illustrated.

Orthogonal coordinate systems in FIGS. 1 to 3 are set such that main surfaces of a substrate 111 and the substrate 112 are in parallel with an x-y plane and a symmetric axis AS (see FIG. 3) of the filter 10 is in parallel with an x-axis. A direction from the resonator 141 toward the resonator 143 is defined as an x-axis positive direction, a direction from the resonator 146 toward the resonator 141 is defined as a y-axis positive direction, and a direction from the substrate 111 toward the substrate 112 is defined as a z-axis positive direction.

As shown in FIGS. 1 and 2, the filter 10 includes a multilayer substrate 11, ground conductor layers 12 and 13, the resonators 141 to 146, the lines 151 and 152, the vias 161 and 162, and through vias 171 to 177.

<Multilayer Substrate>

The multilayer substrate 11 includes the substrates 111 and 112 and an adhesive layer. In FIGS. 1 and 2, the adhesive layer is not illustrated.

The substrates 111 and 112 are two plate-like members each made of a dielectric. In the state illustrated in FIG. 1, the substrate 112 is disposed above (i.e., on a z-axis positive direction side of) the substrate 111. Hereinafter, one of the paired main surfaces of the substrate 111 which one is farther from the substrate 112 will be referred to as an outer layer LO11, one of the paired main surfaces of the substrate 112 which one is farther from the substrate 111 will be referred to as an outer layer LO12, and a layer between the substrates 111 and 112 will be referred to as an inner layer LI1.

In this embodiment, the substrates 111 and 112 are each made of a liquid crystal polymer resin. Note that the dielectric constituting the substrates 111 and 112 is not limited to the liquid crystal polymer resin, and may alternatively be a glass epoxy resin, an epoxy composition, a polyimide resin, or the like. In this embodiment, each of the substrates 111 and 112 has a rectangular shape in a plan view. Note that the shape of each of the substrates 111 and 112 is not limited to the rectangular shape, and can be selected as appropriate.

The adhesive layer is provided to the inner layer LI1, and bonds the substrates 111 and 112 to each other. An adhesive constituting the adhesive layer is not limited to any particular type, and may be selected as appropriate from among existing adhesives.

<Ground Conductor Layer>

The ground conductor layer 12 is constituted by a conductor film provided to the outer layer LO11. The ground conductor layer 13 is constituted by a conductor film provided to the outer layer LO12. The ground conductor layers 12 and 13 are an example of the paired ground conductor layers facing each other. Together with the later-described resonators 141 to 146 and lines 151 and 152, the ground conductor layers 12 and 13 constitute a strip line.

In one aspect of the present invention, out of the ground conductor layers 12 and 13, the ground conductor layer 13 can be omitted. In a case where the ground conductor layer 13 is omitted, the substrate 112 can also be omitted. In a case where the ground conductor layer 13 is omitted, the ground conductor layer 12 constitutes a microstrip line, together with the later-described resonators 141 to 146 and lines 151 and 152.

In this embodiment, the ground conductor layers 12 and 13 are each made of copper. Note that the conductor constituting the ground conductor layers 12 and 13 is not limited to copper, and may alternatively be gold, aluminum, or the like.

As shown in FIGS. 2 and 3, the ground conductor layer 12 has anti-pads 121 and 122. In a plan view, the anti-pad 121 is formed so as to surround an area overlapping, out of the ends of the line 151, an end 1511 not connected to the resonator 141 (see FIG. 3). In a plan view, the anti-pad 122 is formed so as to surround an area overlapping, out of the ends of the second line 152, an end 1521 not connected to the resonator 146 (see FIG. 3). The end 1511 is an example of the first end, and the end 1521 is an example of the second end.

Hereinafter, an area surrounded by the anti-pad 121 will be referred to as a land 123, and an area surrounded by the anti-pad 122 will be referred to as a land 124. The anti-pad 121 is an example of the first anti-pad, and the anti-pad 122 is an example of the second anti-pad. The land 123 is an example of the first land, and the land 124 is an example of the second land.

<Resonator>

The resonators 141 to 146, which are six resonators, are an example of the n resonators arranged in the layer spaced from the ground conductor layer 12. Thus, in this embodiment, n=6. Note that n is an arbitrary even number of not less than 4.

The resonators 141 to 146 are arranged so as to be spaced from each other so that adjacent ones of the resonators are spaced from each other at a given interval. In one aspect of the present invention, the number of resonators is not limited to six, but can be selected as appropriate in order to achieve desired reflection characteristics and desired transmission characteristics.

In this embodiment, the filter 10 is a strip-line filter. Therefore, the resonators 141 to 146 are provided so as to be spaced from the ground conductor layers 12 and 13 and to be interposed between the ground conductor layers 12 and 13. In this embodiment, the resonators 141 to 146 are provided in the inner layer LI1.

As shown in FIGS. 1 to 3, the resonators 141 to 146 are each made of a long narrow conductor. As shown in FIG. 3, the resonators 141 to 146 are each made of a long narrow conductor bent in the inner layer LI1 so that paired ends thereof form a corresponding one of the gaps G1 to G6.

In this embodiment, the resonators 141 to 146 are each made of copper. Note that the conductors constituting the resonators 141 to 146 are not limited to copper, and may alternatively be gold, aluminum, or the like.

The resonators 141 to 146 are arranged in two rows and three columns. The resonator 141 is an example of the first resonator, the resonator 142 is an example of the second resonator, and the resonator 143 is an example of the third resonator. The resonator 141 is disposed on a first row and a first column, the resonator 142 is disposed on the first row and a second column, and the resonator 143 is disposed on the first row and a third column. The resonator 144 is disposed on a second row and the third column, the resonator 145 is disposed on the second row and the second column, and the resonator 146 is disposed on the second row and the first column. The resonator 145 is an example of the n−1-th resonator, and the resonator 146 is an example of the n-th resonator.

The resonator 141 is connected to the later-described line 151, and the resonator 146 is connected to the later-described line 152.

(Shape of Resonator)

As shown in FIG. 3, the resonators 141 to 146 are each made of a long narrow conductor bent in the inner layer LI1. More specifically, each of the resonators 141 to 146 is formed by bending a respective long narrow conductor constituting the resonator so that the paired ends of the long narrow conductor form a corresponding one of gaps G1 to G6 and the long narrow conductor forms a quadrangular shape.

In this embodiment, each of the resonators 141 to 146 has a square shape. FIG. 3 shows, by double-dashed lines, squares R1 to R6 respectively corresponding to the center axes of the long narrow conductors constituting the resonators 141 to 146. Note that the shape of each of the resonators 141 to 146 is not limited to the square shape, but may alternatively be a rectangular shape. Note also that the shapes of the resonators 141 to 146 may be the same or different from each other.

Out of the four sides of the resonator 141, a first side, which is a side close to the resonator 142 (a side on the x-axis positive direction side), will be referred to as a side R11, a second side, which is a side close to the resonator 146 (a side on the y-axis negative direction side) will be referred to as a side R12, a third side, which is a side opposite to the side R11, will be referred to as a side R13, and a fourth side, which is a side opposite to the side R12, will be referred to as a side R14.

In the resonator 141, the gap G1 is provided in an area of the side R14 which area is close to the resonator 142 (an area on the x-axis positive direction side). In this embodiment, the gap G1 is provided in a part of the side R14 which part is close to an end of the side R14 close to the resonator 142 (an end on the x-axis positive direction side).

Out of the four sides of the resonator 146, a fifth side, which is a side close to the resonator 145 (a side on the x-axis positive direction side), will be referred to as a side R61, a sixth side, which is a side close to the resonator 141 (a side on the y-axis positive direction side) will be referred to as a side R62, a seventh side, which is a side opposite to the side R61, will be referred to as a side R63, and an eighth side, which is a side opposite to the side R62, will be referred to as a side R64.

In the resonator 146, the gap G6 is provided in an area of the side R64 which area is close to the resonator 145 (an area on the x-axis positive direction side). In this embodiment, the gap G6 is provided in a part of the side R64 which part is close to an end of the side R64 close to the resonator 145 (an end on the x-axis positive direction side).

The later-described line 151 is connected to the side R13 of the resonator 141, and the later-described line 152 is connected to the side R63 of the resonator 146. The line 151 is preferably connected to an area of the side R13 which area is close to the resonator 146 (an area on the y-axis negative direction side), and the line 152 is preferably connected to an area of the side R63 which area is close to the resonator 141 (an area on the y-axis positive direction side). The line 151 is more preferably connected to a part near a midpoint of the side R13, and the line 152 is more preferably connected to a part near a midpoint of the side R63. The area of the side R13 which area is close to the resonator 146 refers to an area extending from the midpoint of the side R13 toward the resonator 146, and the area of the side R63 which area is close to the resonator 141 refers to an area extending from the midpoint of the side R63 toward the resonator 141. In this embodiment, the line 151 is connected to the midpoint of the side R13, and the line 152 is connected to the midpoint of the side R63.

The resonator 142 is disposed such that the gap G2 faces a direction closer to the resonator 145 (i.e., the y-axis negative direction). The resonator 143 is disposed such that the gap G3 faces a direction farther from the resonator 144 (i.e., the y-axis positive direction). The resonator 144 is disposed such that the gap G4 faces a direction farther from the resonator 143 (i.e., the y-axis negative direction). The resonator 145 is disposed such that the gap G5 faces a direction closer to the resonator 142 (i.e., the y-axis positive direction).

In other words, the resonators 141 to 146, which are examples of the first to sixth resonators, are arranged such that one side of an i-th resonator and one side of an i+1-th resonator are close to each other and a gap of the second resonator and a gap of the fifth resonator are close to each other, where i is an integer of not less than 1 and not more than 5. Specifically, (1) the resonator 141 and the resonator 142 are arranged so that the side R11 and the side R22 are close to each other, (2) the resonator 142 and the resonator 143 are arranged so that the side R24 and the side R34 are close to each other, (3) the resonator 143 and the resonator 144 are arranged so that the side R33 and the side R43 are close to each other, (4) the resonator 144 and the resonator 145 are arranged so that the side R42 and the side R52 are close to each other, (5) the resonator 145 and the resonator 146 are arranged so that the side R54 and the side R61 are close to each other, and (6) the resonator 142 and the resonator 145 are arranged so that the gap G2 and the gap G5 are close to each other. Note that the resonator 141 and the resonator 146 are arranged so that the side R12 and the side R62 are close to each other.

Note that the shape into which each of the long narrow conductors constituting the resonators 141 to 146 is bent is not limited to the quadrangular shape, but may be a shape having at least four sides.

(Coupling Between Adjacent Resonators)

In the filter 10 including the resonators 141 to 146 arranged in the above-described manner, (1) coupling between the resonators 141 and 142, (2) coupling between the resonators 142 and 143, (3) coupling between the resonators 143 and 144, (4) coupling between the resonators 144 and 145, (5) coupling between the resonators 145 and 146, and (6) coupling between the resonators 141 and 146 are mostly magnetic, whereas (7) coupling between the resonators 142 and 145 is mostly electrostatic. Specifically, among the resonators 142 to 145, (1) the paired resonators 142 and 145 arranged in an even number column each have the four sides R21 to R24 or the four sides R51 to R54 including the side R21 or R51 having a gap G2 or G5 provided near the midpoint of the side R21 or R51, the sides R21 and R51 being close to each other, and (2) the paired resonators 143 and 144 arranged in an odd number column each have the four sides R31 to R34 or the four sides R41 to R44 including the side (i.e., the side R31 or R41) having a gap G3 or G4 provided near the midpoint of the side (i.e., the side R31 or R41), the sides (i.e., the sides R31 and R41) being opposite to the sides (i.e., the sides R33 and R43) close to each other.

In order to achieve a group delay compensation filter or an equal group delay filter, resonators are often arranged so that a first-pole resonator and a last-pole resonator are electrostatically coupled to each other, like the bandpass filter disclosed in FIG. 1 of Non-Patent Literature 1. Meanwhile, in order to achieve an elliptic function bandpass filter that includes six resonators and that is configured to select a sharp band to be used, coupling between the second resonator and the fifth resonator is often made electrostatic and coupling between the other resonators is often made magnetic. In a case where an aspect of the present invention is adopted to achieve an elliptic function bandpass filter including six resonators, coupling that can occur between the later-described paired input/output ports can be reduced and accordingly its effect on the filter characteristics can be reduced, as compared to the configuration of the bandpass filter disclosed in FIG. 1 of Non-Patent Literature 1 or the like.

<Line>

The lines 151 and 152 are provided in a layer in which the resonators 141 to 146 are provided, i.e., in the inner layer LI1. Each of the lines 151 and 152 is constituted by a long narrow conductor having a linear shape. The lines 151 and 152 and the resonators 141 to 146 are made of a conductor of the same type. Thus, in this embodiment, the lines 151 and 152 are each made of copper. Note that the conductor of which the lines 151 and 152 are made is not limited to copper, and may alternatively be gold, aluminum, or the like.

The line 151 is an example of the first line, and the line 152 is an example of the second line. The line 151 has one end connected to the resonator 141, at a connection point PC1, which is the midpoint of the side R13. The line 151 is drawn out from the connection point PC1 in the x-axis negative direction. The line 152 has one end connected to the resonator 146, at a connection point PC2, which is the midpoint of the side R63. The line 152 is drawn out from the connection point PC2 in the x-axis negative direction. Thus, the direction in which the line 151 is drawn out and the direction in which the line 152 is drawn out are in parallel with each other and are identical.

<Via>

The vias 161 and 162, which are examples of the first via and the second via, are tubular members each made of a conductor. The vias 161 and 162 are provided in the substrate 111, which is one of the two substrates 111 and 112 constituting the multilayer substrate 11. Alternatively, the vias 161 and 162 may be columnar members each made of a conductor.

In a plan view, the via 161 is provided in an area where the land 123 provided in the ground conductor layer 12 and the end 1511, which is the other end of the line 151, overlap each other. The via 161 allows the land 123 and the end 1511 to be short-circuited to each other. The via 162 is provided in an area where the land 124 provided in the ground conductor layer 12 and the end 1521, which is the other end of the line 152, overlap each other. The via 162 allows the land 124 and the end 1521 to be short-circuited to each other.

The land 123 and the via 161 function as one of the pairs of input-output ports in the filter 10. Similarly, the land 124 and the via 162 function as one of the pairs of input-output ports in the filter 10.

Note that the scope of the present invention also encompasses a configuration not including the land 123, the via 161, the land 124, or the via 162. However, in a case where the filter 10 is actually used, the filter 10 is mounted on the mounting substrate 20, as shown in FIG. 2. In view of this, Example 2 and Comparative Example 2, each of which includes the lands and vias, are more practical configurations.

<Through Via>

The seven through vias 171 to 177 are tubular members each made of a conductor, and are provided in the multilayer substrate 11 so as to penetrate through the multilayer substrate 11. Alternatively, the through vias 171 to 177 may be columnar members each made of a conductor. Each of the through vias 171 to 177 allows the ground conductor layer 12 and the ground conductor layer 13 to be short-circuited to each other.

<Symmetry in Filter>

As shown in FIG. 3, in a plan view, the resonators 141 to 146 and the lines 151 and 152 are arranged so as to have line symmetry with respect to the symmetric axis AS. The symmetric axis AS is an axis that is in parallel with a direction (i.e., the x-axis direction) in which the lines 151 and 152 extend and that is located in the middle between the resonators 141 and 146.

<Mounting Substrate>

As described above, the filter 10 shown in FIG. 2 is in a state where the filter 10 is mounted on the mounting substrate 20. The description here will discuss the mounting substrate 20 with reference to FIG. 2. The mounting substrate 20 includes a multilayer substrate 21, a ground conductor layer 22, and a ground conductor layer 23.

The multilayer substrate 21 includes substrates 211 and 212 and an adhesive layer. In FIG. 2, the adhesive layer is not illustrated.

(Multilayer Substrate)

The substrates 211 and 212 are two plate-like members each made of a dielectric. In the state shown in FIG. 2, the substrate 211 is a substrate closer to the filter 10, and the substrate 212 is disposed below (i.e., on the z-axis negative direction side of) the substrate 211. Hereinafter, one of the paired main surfaces of the substrate 211 which one is farther from the substrate 212 will be referred to as an outer layer LO21, one of the paired main surfaces of the substrate 212 which one is farther from the substrate 211 will be referred to as an outer layer LO22, and a layer between the substrates 211 and 212 will be referred to as an inner layer LI2. The adhesive layer is provided to the inner layer LI2, and bonds the substrates 211 and 212 to each other.

(Ground Conductor Layer)

The ground conductor layer 22 is constituted by a conductor film provided to the outer layer LO21. The ground conductor layer 23 is constituted by a conductor film provided to the outer layer LO22. The ground conductor layers 22 and 23 constitute a strip line, together with the later-described lines 251 and 252.

As shown in FIG. 2, the ground conductor layer 22 has anti-pads 221 and 222. Hereinafter, an area surrounded by the anti-pad 221 will be referred to as a land 223, and an area surrounded by the anti-pad 222 will be referred to as a land 224. In this embodiment, a center-to-center distance between the lands 223 and 224 is equal to a center-to-center distance between the lands 123 and 124.

(Line)

The lines 251 and 252 are linear long narrow conductors provided in the inner layer LI2. In a plan view, the line 251 has one end overlapping the land 223. In a plan view, the line 252 has one end overlapping the land 224. As described above, the lines 251 and 252 constitute the strip line, together with the ground conductor layers 22 and 23.

(Via)

The vias 261 and 262 are tubular members each made of a conductor. The vias 261 and 262 are provided in the substrate 211, which is one of the two substrates 211 and 212 constituting the multilayer substrate 21. Alternatively, the vias 261 and 262 may be columnar members each made of a conductor.

In a plan view, the via 261 is provided in an area where the land 223, provided in the ground conductor layer 22, and the one end of the line 251 overlap each other. The via 261 allows the land 223 and the one end of the line 251 to be short-circuited to each other. The via 262 is provided in an area where the land 224, provided in the ground conductor layer 22, and the one end of the line 252 overlap each other. The via 262 allows the land 224 and the one end of the line 252 to be short-circuited to each other.

The land 223 and the via 261 function as one of the pairs of input-output ports in the mounting substrate 20. Similarly, the land 224 and the via 262 function as one of the pairs of input-output ports in the mounting substrate 20.

(Solder)

In this embodiment, the filter 10 is mounted on the mounting substrate 20 via solders 31, 32, and 33.

The solder 31 allows electrical connection between the lands 123 and 223, and fixes the filter 10 to the mounting substrate 20. The solder 32 allows electrical connection between the lands 124 and 224, and fixes the filter 10 to the mounting substrate 20. The plurality of solders 33 allow the ground conductor layer 12 and the ground conductor layer 22 to be short-circuited to each other, and fix the filter 10 to the mounting substrate 20.

As described above, the filter 10 can be easily mounted on the mounting substrate 20 with a small loss.

Examples 1 and 2

Examples 1 and 2 each correspond to the filter 10 shown in FIGS. 1 to 3 modified such that the vias 161 and 162 and the anti-pads 121 and 122 formed in the ground conductor layer 12 are omitted. Thus, the ground conductor layers 12 of Examples 1 and 2 are solid films not provided with the land 123 or 124. The conventional filter 2010 shown in FIG. 5 is adopted as each of Comparative Examples 1 and 2. A distance between the lines 2151 and 2152 in Comparative Examples 1 and 2 is shorter than a distance between the lines 151 and 152 in Examples 1 and 2.

In Examples 1 and 2 and Comparative Examples 1 and 2, a long narrow conductor constituting each resonator has a width of 120 μm, and each resonator is bent into a square shape having a side of approximately 1 mm.

In Example 1 and Comparative Example 1, the lines 151 and 152 and the lines 2151 and 2152 each have a length of 0.9 mm. Meanwhile, in Example 2 and Comparative Example 2, the lines 151 and 152 and the lines 2151 and 2152 each have a length of 1.9 mm.

(a) to (d) of FIG. 4 respectively show graphs indicating S parameters of Comparative Example 1, Example 1, Comparative Example 2, and Example 2. These S parameters were obtained by simulations. In each of (a) to (d) of FIG. 4, an S parameter S11 is plotted in a solid line, and an S parameter S21 is indicated by a dotted line. Hereinafter, a frequency dependency of the S parameter S11 will be referred to as reflection characteristics, and a frequency dependency of the S parameter S21 will be referred to as transmission characteristics.

With reference to (a) and (b) of FIG. 4, it was found that both Comparative Example 1 and Example 1 exhibited favorable reflection characteristics and favorable transmission characteristics. It was also found that, in Comparative Example 1 and Example 1, a zero transmission point PZL on a low frequency side was located near 22 GHz, and a zero transmission point PZH on a high frequency side was located near 29 GHz.

With reference to (c) of FIG. 4, it was found that, in Comparative Example 2, the S parameter S21 was suppressed in a cutoff band more poorly than in Comparative Example 1. It was also found that, in Comparative Example 2, a zero transmission point PZL was located near 21 GHz, and a zero transmission point PZH was located near 30 GHz. In addition, it was found that, in Comparative Example 2, the zero transmission point PZH was dull and unclear.

Meanwhile, with reference to (d) of FIG. 4, it was found that Example 2 exhibited favorable reflection characteristics and favorable transmission characteristics similar to those exhibited in Example 1. In addition, it was found that the zero transmission point PZL and the zero transmission point PZH in Example 2 were located near 22 GHz and 29 GHz, respectively, similarly to those in Example 1.

It is considered that these results were obtained due to a phenomenon that a greater distance between paired lines 151 and 152 can better suppress coupling that may unexpectedly occur between the paired lines 151 and 152.

Note that, as described above, Examples 1 and 2 each employ the filter 10 modified such that the vias 161 and 162 the anti-pads 121 and 122 in the ground conductor layer 12 are omitted. The reason for this is as follows: In a case where the filters 2010 of Comparative Examples 1 and 2 are configured to additionally include paired vias corresponding to the vias 161 and 162 and paired anti-pads corresponding to the anti-pads 121 and 122, the filters 2010 configured as such would exhibit filter characteristics so deteriorated as no longer to be compared to those in Examples 1 and 2, since the paired vias and paired lands are close to each other. In view of this, it can be said that an aspect of the present invention is suitable for a case where paired input/output ports are constituted by the vias 161 and 162 and the lands 123 and 124 as in the filter 10 shown in FIGS. 1 to 3.

(Supplementary Note)

The present invention is not limited to the embodiments, but can be altered by a skilled person in the art within the scope of the claims. The present invention also encompasses, in its technical scope, any embodiment derived by combining technical means disclosed in differing embodiments.

Aspects of the present invention can also be expressed as follows:

A bandpass filter in accordance with a first aspect of the present invention includes: at least one ground conductor layer; n resonators arranged in two rows and n/2 columns in a layer spaced from the at least one ground conductor layer, n being an even number of not less than 4, each of the n resonators being made of a long narrow conductor bent into a shape having at least four sides and having a gap; and a first line and a second line each made of a long narrow conductor, wherein among the n resonators, a resonator disposed on a first row and a first column is a first resonator, a resonator disposed on the first row and a second column is a second resonator, a resonator disposed on a second row and the first column is an n-th resonator, and a resonator disposed on the second row and the second column is an n−1-th resonator, in the first resonator, a side close to the second resonator is a first side, a side close to the n-th resonator is a second side, a side opposite to the first side is a third side, and a side opposite to the second side is a fourth side, in the n-th resonator, a side close to the n−1-th resonator is a fifth side, a side close to the first resonator is a sixth side, a side opposite to the fifth side is a seventh side, and a side opposite to the sixth side is an eighth side, the first line is connected to the third side and the second line is connected to the seventh side, and the first resonator has a gap in an area of the fourth side which area is close to the second resonator, and the n-th resonator has a gap in an area of the eighth side which area is close to the n−1-th resonator.

A bandpass filter configured as above is a type of bandpass filter that is called a strip-line filter or a microstrip filter.

With the above configuration, the first line can be connected to the area of the third side which area is close to the n-th resonator, while the gap of the first resonator is provided in the fourth side. Similarly, the second line can be connected to the area of the seventh side which area is close to the first resonator, while the gap of the n-th resonator is provided in the eighth side. Therefore, in the bandpass filter in accordance with this aspect, a distance between the first and second lines can be increased, as compared to that in a bandpass filter including a first line connected to an end of a third side which end is close to an n-th resonator and a second line connected to an end of a seventh side which end is close to the first resonator. Thus, the bandpass filter in accordance with this aspect can reduce a variation in filter characteristics that can occur in a case where the design of the first line and the second line is changed.

A bandpass filter in accordance with a second aspect of the present invention is configured such that, in addition to the feature(s) of the bandpass filter in accordance with the first aspect, the gap of the first resonator is provided near an end of the fourth side which end is close to the second resonator, and the gap of the n-th resonator is provided near an end of the eighth side which end is close to the n−1-th resonator.

With the above configuration, it is possible to maximize a distance between the end of the third side which end is close to the n-th resonator and the gap of the first resonator, while allowing the first resonator and the second resonator to be magnetically coupled to each other. Consequently, the connection point at which the first line is connected to the long narrow conductor constituting the first resonator can be shifted from the end of the third side which end is close to the n-th resonator to the area of the third side close to the n-th resonator, without the need for significantly changing the relative position of the connection point. Similarly, the connection point at which the second line is connected to the long narrow conductor constituting the n-th resonator can be shifted from the end of the seventh side which end is close to the first resonator to the area of the seventh side close to the first resonator, without the need for significantly changing the relative position of the connection point. This can further reduce a variation in filter characteristics that can occur in a case where the design of the first line and the second line is changed.

A bandpass filter in accordance with a third aspect of the present invention is configured such that, in addition to the feature(s) of the bandpass filter in accordance with the first or second aspect, the first line is connected to an area of the third side which area is close to the n-th resonator, and the second line is connected to an area of the seventh side which area is close to the first resonator.

With the above configuration, it is possible to increase a distance between the first and second lines, as compared to a bandpass filter including a first line connected to an end of a third side which end is close to an n-th resonator and a second line connected to an end of a seventh side which end is close to the first resonator. Thus, the bandpass filter in accordance with this aspect can reliably reduce a variation in filter characteristics that can occur in a case where the design of the first line and the second line is changed.

A bandpass filter in accordance with a fourth aspect of the present invention is configured such that, in addition to the feature(s) of the bandpass filter in accordance with the third aspect, the first line is connected to a part of the third side which part is near a midpoint of the third side, and the second line is connected to a part of the seventh side which part is near a midpoint of the seventh side.

It is found that, in a case where the first line is connected to the area of the third side which area is close to the n-th resonator and the second line is connected to the area of the seventh side which area is close to the first resonator, a distance between the connection point at which the first line is connected to the third side and the gap of the first resonator and a distance between the connection point at which the second line is connected to the seventh side and the gap of the second resonator are so short that the filter characteristics are deteriorated. The above configuration can reduce, as much as possible, a variation in filter characteristics that can occur in a case where the design of the first line and the second line is changed.

A bandpass filter in accordance with a fifth aspect of the present invention is configured such that, in addition to the feature(s) of the bandpass filter in accordance with any one of the first to fourth aspects, among the second to n−1-th resonators, (1) paired resonators arranged in an even number column each have four sides including one side having a gap provided near a midpoint of the one side, the one side among the four sides of one of the paired resonators arranged in the even number column and the one side among the four sides of the other of the paired resonators arranged in the even number column being close to each other, and (2) paired resonators arranged in an odd number column each have four sides including one side having a gap provided near a midpoint of the one side, the one side among the four sides of one of the paired resonators arranged in the odd number column being opposite to another side among the four sides of the one of the paired resonators arranged in the odd number column, the one side among the four sides of the other of the paired resonators arranged in the odd number column being opposite to another side among the four sides of the other of the paired resonators arranged in the odd number column, the another side among the four sides of the one of the paired resonators arranged in the odd number column and the another side among the four sides of the other of the paired resonators arranged in the odd number column being close to each other.

With the above configuration, among the first to n-th resonators, the paired resonators arranged in the even number column are electrostatically coupled to each other, and the paired resonators arranged in the odd number column, including the first column, are magnetically coupled to each other. In a case where the bandpass filter configured in this manner is adopted to achieve an elliptic function bandpass filter, coupling that can occur between the later-described paired input/output ports can be reduced and accordingly its effect on the filter characteristics can be reduced, as compared to the configuration of the bandpass filter disclosed in FIG. 1 of Non-Patent Literature 1.

A bandpass filter in accordance with a sixth aspect of the present invention is configured such that, in addition to the feature(s) of the bandpass filter in accordance with any one of the first to fifth aspects, the shape having at least four sides is a quadrangular shape.

With the above configuration, the n resonators can be easily arranged in two rows and n/2 columns.

A bandpass filter in accordance with a seventh aspect of the present invention is configured such that, in addition to the feature(s) of the bandpass filter in accordance with any one of the first to sixth aspects, the at least one ground conductor layer includes paired ground conductor layers facing each other, and the n resonators are interposed between the paired ground conductor layers.

With the above configuration, the n resonators are sandwiched between the paired ground conductor layers, and therefore the paired ground conductor layers can shield the n resonators from the outside.

A bandpass filter in accordance with an eighth aspect of the present invention is configured such that, in addition to the feature(s) of the bandpass filter in accordance with any one of the first to seventh aspects, n=6, and the first to sixth resonators are arranged such that a side of an i-th resonator and a side of an i+1-th resonator are close to each other, and a gap of the second resonator and a gap of the fifth resonator are close to each other, where i is an integer of not less than 1 and not more than 5.

With the above configuration, the i-th resonator and the i+1-th resonator can be coupled to each other mostly magnetically, and the second resonator and the fifth resonator can be coupled to each other mostly electrostatically. Thus, the bandpass filter in accordance with this aspect is likely to achieve desired filter characteristics.

A bandpass filter in accordance with a ninth aspect of the present invention is configured such that, in addition to the feature(s) of the bandpass filter in accordance with any one of the first to eighth aspects, the n resonators, the first line, and the second line are arranged so as to have line symmetry.

With the above configuration, the bandpass filter can be made more symmetric. This makes it possible to reduce design parameters. Thus, the bandpass filter in accordance with this aspect can be designed more easily, as compared to a bandpass filter in which n resonators, a first line, and a second line are arranged so as not to have line symmetry.

REFERENCE SIGNS LIST

10: Filter (bandpass filter)
11: Multilayer substrate
111, 112: Substrate
LI1: Inner layer
LO11, LO12: Outer layer
12: Ground conductor layer
121, 122: Anti-pad
123, 124: Land
13: Ground conductor layer
141 to 146: Resonator (first resonator to sixth resonator, n resonators)
PC1, PC2: Connection point
G1 to G6: Gap
R1, R2, R3, R4, R5, R6: Square
R11 to R14, R21 to R24, R31 to R34, R41 to R44, R51 to R54, R61 to R64: Side
151, 152: Line (first line, second line)
1511, 1521: End
161, 162: Via
171 to 177: Through via
AS: Symmetric axis

The invention claimed is:

1. A bandpass filter comprising:

at least one ground conductor layer;

n resonators arranged in two rows and n/2 columns in a layer spaced from said at least one ground conductor layer, n being an even number of not less than 4, each of the n resonators being made of a long narrow conductor bent into a shape having at least four sides and having a gap; and a first line and a second line each made of a long narrow conductor, wherein among the n resonators, a resonator disposed on a first row and a first column is a first resonator, a resonator disposed on the first row and a second column is a second resonator, a resonator disposed on a second row and the first column is an n-th resonator, and a resonator disposed on the second row and the second column is an n−1-th resonator, in the first resonator, a side close to the second resonator is a first side, a side close to the n-th resonator is a second side, a side opposite to the first side is a third side, and a side opposite to the second side is a fourth side, in the n-th resonator, a side close to the n−1-th resonator is a fifth side, a side close to the first resonator is a sixth side, a side opposite to the fifth side is a seventh side, and a side opposite to the sixth side is an eighth side, the first line is connected to the third side and the second line is connected to the seventh side, and the first resonator has a gap in an area of the fourth side which area is closer to the second resonator than a midpoint of the fourth side, and the n-th resonator has a gap in an area of the eighth side which area is closer to the n−1-th resonator than a midpoint of the eighth side.

2. The bandpass filter as set forth in claim 1, wherein the gap of the first resonator is provided near an end of the fourth side which end is close to the second resonator, and the gap of the n-th resonator is provided near an end of the eighth side which end is close to the n−1-th resonator.

3. The bandpass filter as set forth in claim 1, wherein the first line is connected to an area of the third side which area is close to the n-th resonator, and the second line is connected to an area of the seventh side which area is close to the first resonator.

4. The bandpass filter as set forth in claim 3, wherein the first line is connected to a part of the third side which part is near a midpoint of the third side, and the second line is connected to a part of the seventh side which part is near a midpoint of the seventh side.

5. The bandpass filter as set forth in claim 1, wherein among the second to n−1-th resonators, paired resonators arranged in an even number column each have four sides including one side having a gap provided near a midpoint of the one side, the one side among the four sides of one of the paired resonators arranged in the even number column and the one side among the four sides of the other of the paired resonators arranged in the even number column being close to each other, and paired resonators arranged in an odd number column each have four sides including one side having a gap provided near a midpoint of the one side, the one side among the four sides of one of the paired resonators arranged in the odd number column being opposite to another side among the four sides of the one of the paired resonators arranged in the odd number column, the one side among the four sides of the other of the paired resonators arranged in the odd number column being opposite to another side among the four sides of the other of the paired resonators arranged in the odd number column, said another side among the four sides of the one of the paired resonators arranged in the odd number column and said another side among the four sides of the other of the paired resonators arranged in the odd number column being close to each other.

6. The bandpass filter as set forth in claim 1, wherein the shape having at least four sides is a quadrangular shape.

7. The bandpass filter as set forth in claim 1, wherein said at least one ground conductor layer comprises paired ground conductor layers facing each other, and the n resonators are interposed between the paired ground conductor layers.

8. The bandpass filter as set forth in claim 1, wherein n=6, and the first to sixth resonators are arranged such that a side of an i-th resonator and a side of an i+1-th resonator are close to each other and a gap of the second resonator and a gap of the fifth resonator are close to each other, where i is an integer of not less than 1 and not more than 5.

9. The bandpass filter as set forth in claim 1, wherein the n resonators, the first line, and the second line are arranged so as to have line symmetry.

* * * * *